United States Patent [19]

Salete

[11] Patent Number: 4,813,613

[45] Date of Patent: Mar. 21, 1989

[54] PROCESS FOR THE OBTENTION OF HIGH PURITY MUCILAGE

[76] Inventor: Felipe Salete, Av. Ano de Juarez 198, Col. Granjas Sn. Antonio, Mexico, 09070

[21] Appl. No.: 219,844

[22] Filed: Jul. 8, 1988

Related U.S. Application Data

[63] Continuation of Ser. No. 20,441, Mar. 2, 1987, abandoned.

[30] Foreign Application Priority Data

Jan. 1, 1987 [MX] Mexico ..... 4874

[51] Int. Cl.[4] ..... B02C 19/12

[52] U.S. Cl. ..... 241/7; 241/11; 241/14; 426/482

[58] Field of Search ..... 241/24, 29, 30, 7, 9, 241/10, 11, 27, 13, 14, 188 A, 188 R; 99/602–615, 617–621, 519; 426/481–483, 518

[56] References Cited

U.S. PATENT DOCUMENTS

| | | | |
|---|---|---|---|
| 901,217 | 10/1908 | Touya | 241/188 A |
| 2,428,670 | 10/1947 | Hulse | 241/188 A |
| 3,219,286 | 11/1965 | Doyle et al. | 241/188 A |
| 4,292,890 | 10/1981 | Salete | 99/603 |
| 4,583,455 | 4/1986 | Salete | 99/519 |

*Primary Examiner*—Mark Rosenbaum

*Attorney, Agent, or Firm*—Bernard, Rothwell & Brown

[57] ABSTRACT

High purity mucilage from *Plantago psyllium* seeds may be obtained by grinding the integral *Plantago psyllium* seeds by subjecting the same to pure impact grinding action without any rubbing, with an impact speed of from approximately 30 to approximately 40 meters per second and with a flow rate of the integral seed suitable to maintain the individual seeds spaced so that the impact strength is maintained constant for each seed, whereby the husk is removed from the core of the seed without fracturing said cores, in order to avoid contamination of said husk with particles of the core of the seeds.

14 Claims, 3 Drawing Sheets

PROCESS FOR THE OBTENTION OF HIGH PURITY MUCILAGE

This is a continuation of application Ser. No. 020,441 filed Mar. 2, 1987, now abandoned.

FIELD OF THE INVENTION

The present invention refers to a process for the obtention of high purity mucilage from *Plantage psyllium* seeds and, more particularly, it is related to a process for the obtention of powdered husk of the *Plantago Psyllium* seed, with a high mucilage content and with a purity of up to 98%.

BACKGROUND OF THE INVENTION

As is well known, the husk from the *Plantago psyllium* seeds, contains a high percentage of mucilage which is mainly composed of xylose, arabinose and galacturonic acid. Said husk also contains substantial amounts of rhamose and galactose, and said powdered husk being broadly utilized throughout the world as emollient and laxative, being particularly useful in the treatment of chronic constipation, amoebic and bacillary disentery, and in the treatment of diarrhea due to conditions of irritation in the gastrointestinal tract. It is also well known that the action of said powder is purely mechanical and is due to a large extent to the substantial amount of mucilage contained thereby Also, its utilization in the treatment of febrile conditions as well as in certain diseases of kidneys, bladder and urethra has been contemplated in combination with other products such as anhydrous dextrose, sodium bicarbonate, citric acid and the like.

As for the above mentioned purposes the cores of the *Plantago psyllium* seeds have no usefulness whatsoever, the workers in this field have endeavored to devise proceses for husking *Plantago psyllium* seed and isolating the husk, which in the form of a fine powder is used for the above mentioned purposes. The problem faced by the workers in this field of husking the very small seed of *Plantago psyllium,* have been considerable and up to the present time no one has accomplished a process for the production of *Plantago psyllium* mucilage (contained in the husk) which may be regarded as efficient and economical.

Applicant has the knowledge that very few processing systems for the *Plantago psyllium* seed are in existence at the present time, and all of them show very serious drawbacks, inasmuch as they are very primitive, antieconomical and difficult to control systems, and they also require a high number of machines and elements to accomplish the goal of husking the *Plantago psyllium* seed.

In the above mentioned respect, applicant knows certain systems that utilize stone mills for husking the *Plantago psyllium* ends, although these systems, due to the friction and rubbing effect, destroy the grain, comminute and disintegrate the same and thus produce excessive amounts of particulate impurities which are of the same size as the particles of the husk which therefore avoids the appropriate further separation or classification thereof and, therefore, the purity of the powdered husk is decreased. Contrary to the above, the desirable effect would be to loosen the husk without breaking the grain, so that the differences in sizes between the grain and the husk fragments may be substantial so as to permit a ready separation thereof. This goal, however, has not been possible with the use of stone mills. In the process which utilizes this type of stone mills, on the other hand, it is mandatory to provide from 7 to 12 grinding steps or progressive milling steps of very low capacities and, therefore, the said processes using this type of mills have resulted in very costly operations and in an excessive energy consumption, with a low capacity.

Hammer mills have also been found for the same above mentioned purpose, but in this particular instance the impact effect of the hammers and the rubbing of the seeds against the screens contained in said mills, also produce the disintegration of the core of the grain and of the whole grain, thus comminuting the same in excess, with the same consequences already discussed in connection with the stone mills, and with the necessity of including an excessive number of grinding steps in order to accomplish an acceptable production.

In other prior art systems grooved roll mills are used, although in this particular instance, as the grooved rolls operate at a differential speed, they rub and fracture the grains in trying to accomplish the husking effect, and the existence of the defects already described in the above described instances cannot be avoided, namely, the comminution of the grains and the production of excessive amounts of small particles of the core of the grain, which contaminate the husk and prevent the separation and the obtention of particles of husk with the desirable purity. In this particular instance, the utilization of an excessive number of grinding steps in order to accomplish acceptable results is also required.

All the prior art processes which are described above, as already mentioned, require at least from 7 up to 12 grinding steps, with the corresponding number of screening steps for separating the husk particles from the grains and grain cores, which render these processes very complex, antieconomical, difficult to control and of intricate maintenance.

In view of the above, a process has long been sought which would result in the obtention of powdered husk of Plantago Psyllium seeds with a high mucilage content, useful for being used in the pharmaceutical industry, which will not require an excessive number of grinding steps and which, however, may produce a *Plantago psyllium* powdered husk with a very high purity, in order to reduce the production costs of said powdered husk and in order to obtain a product which may be of a purity higher than that which is possible with the systems and processes extant up to the present time as described above. Regardless of the many years during which this research has been made, the above objective has not been accomplished anywhere in the world, whereby the problems extant in this industry for the obtention of a high purity powdered husk of *Plantago psyllium* seed, with a reasonable efficiency, have remained unsolved up to the present date.

OBJECTS OF THE INVENTION

Having in mind the defects of the prior art processes, it is an object of the present invention to provide a process for the obtention of high purity mucilage from *Plantago psyllium* seeds, which will not require the utilization of complex, difficult to control and costly equipment but which, will provide a high efficiency for the obtention of high purity powdered husk of *Plantago psyllium* seed.

It is another object of the present invention to provide a process for the obtention of high purity mucilage from *Plantago psyllium* seeds, of the above mentioned character, which will be capable of obtaining said mucilage by the mere husking and milling of the *Plantago psyllium* seed without the need of incorporating an excessive number of grinding steps.

One other and more particular object of the present invention is to provide a process for the obtention of high purity mucilage from *Plantago psyllium* seeds which will essentially avoid the disintegration of the cores of the *Plantago psyllium* seed which normally impurify the husk obtained.

One other object of the present invention is to provide a process for the obtention of high purity mucilage from *Plantago psyllium* seeds which will accomplish, by very simple means, the optimal separation and loosening of the husk from the core of the plantago psyllium grain without disintegrating the latter and which will eliminate the necessity of additional separating actions for the contaminant particles which are produced when the core of the grain is destroyed or disintegrated.

One other and more particular object of the present invention is to provide a process for the obtention of high purity mucilage from *Plantago psyllium* seeds, of the above mentioned character, which will provide the means necessary for avoiding any type of rubbing, shearing, friction or marring actions on the *Plantago psyllium* grain, so as to provide a husking of the grain with the desired purity without fracturing the core of the grain which is the contaminant portin which damages the product.

One other object of the present invention is to provide a process for the obtention of high purity mucilage from *Plantago psyllium* seeds, of the above described character, which will accomplish an optimal communition of the husk in order to obtain particles of a size such that it will permit a simple separation of said husk from the core of the grains by the mere screening thereof in a short number of screening stages and with the maximum yield and minimum grinding of the cores.

One other and more particular object of the present invention is to provide a process for the obtention of high purity mucilage from *Platago psyllium* seeds, of the above mentioned character, which will provide for effecting an efficient separation of the husk from the core of the grains by means of a stratification action of the product to assist the screening thereof.

The above described objects, as well as others ancillary thereto are preferably accomplished as follows:

In accordance with a preferred embodiment of the present invention, a process is provided for the obtention of high purity mucilage from *Plantago psyllium* seeds, which essentially comprises the steps of: (a) feeding previously cleaned integral *Plantago psyllium* seed to a grinding zone in which it is subjected to an impact grinding action without any rubbing, with an impact speed of from approximately 30 to approximately 40 m/sec. and with the flow rate of the integral seed into said grinding zone suitable to maintain the individual seeds spaced so that the impact strength be constant for each one of them; (b) separating the husk released from the core of the seeds by the action of the impacts, by passing the seed through a screening zone in which it is subjected to vibration through a suitable sieve in order to accomplish a suitable stratification to separate the grains and the husk in different beds or layers; (c) repeating steps (a) and (b) the necessary number of times to accomplish an optimal husking of the seeds; and (d) conveying the husk with a high content of mucilage to finished material storage.

BRIEF DESCRIPTION OF THE DRAWINGS

The novel features that are considered characteristic of the present invention are set forth with particularity in the appended claims. The invention itself, however, both as to its organization and its method of operation, together with additional objects and advantages thereof, will best be understood from the following description of a specific embodiment when read in connection with the accompanying drawings, in which:

DETAILED DESCRIPTION

As it has already been mentioned in the above paragraphs, in order to obtain an optimal removal, loosening or separation of the husk from the core of the *Plantago psyllium* seed without disintegrating said core and in order to also eliminate the need of further separating stages, which are highly ineffective, of the contaminant particles which are created when the core of the seed is destroyed or disintegrated, it is mandatory to satisfy the following conditions:

(a) That the processing of the seed be effected by a pure impact action, with rubbing, shearing, friction or scrubbing effects, in order to produce a husking of the grain with the desired cleanliness and purity, without fracturing the core of the grain which is the contaminant portion that hinders the process.

(b) That the speed of the shock or impact of the grain be preserved at a ratio with respect to the flow rate and fluidified feeding capacity, such that the grains are introduced into the impact chamber individually spaced from each other, in order to secure an identical impact strength on each individual grain and so that said strength be sufficiently accurate to loosen the husk without damaging or fracturing the core of the grain.

(c) That the classification or separation of the husk loosened from the grain be effected on the basis of a screening action with high frequency and moderate displacement machines, in order to obtain a high stratification of the product and not only a simple screening action. This condition accomplishes a separation of the grains from the husk particles in a suitable manner to be able to further homogenize the product by milling the pure husk to obtain the desired sizes.

Figure 1:
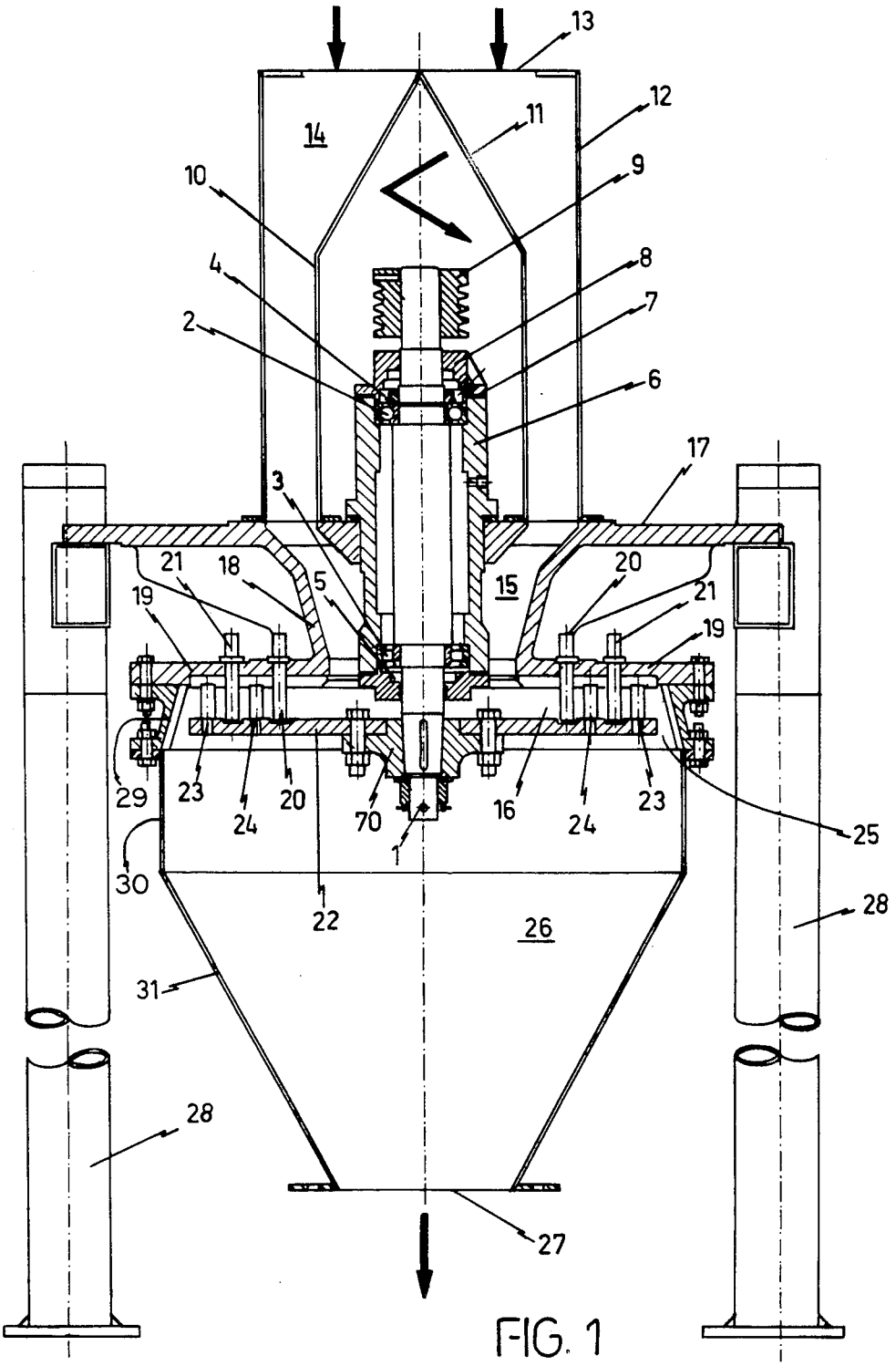
FIG. 1 is a cross-sectional elevational view of an impact mill which is used for carrying out the grinding steps of the process in accordance with the present invention.

After thorough experimentation with many types of mills, applicant has discovered that the necessary equipment which has the adequate combination of percussion impact and optimal grinding action to obtain particles of a predetermined size which will permit a simple separation of the grain from the husk by screening in a short number of stages (for example 3 stages) with a maximum yield and a minimum grinding of the grains, is an impact type mill such as that illustrated in FIG. 1 of the drawings, which represents a bolt mill without any screen and that has a pure impact action on the seeds, within a range of speeds of from about 30 m/sec. as a minimum to about 40 m/sec. as the maximum, and a number of grinding stages which will not exceed three, even though more stages may be utilized under the above mentioned conditions, for a capacity of at least 1000 kg/hr. and the obtention of a powdered husk of *Plantago psyllium* seed with a purity of up to 98%. It is to be noted that if speeds lower than those mentioned above are used, the husk is not loosned and, on the contrary, if speeds higher than the above mentioned speeds are used, the core of the grain commences to be disintegrated with the consequent impurification of the husk which is to be obtained with a high quality and purity.

As also more clearly illustrated in FIGS. 2 and 3 of the drawings which will be described in more detail hereinbelow, the separation or classification of the husk is effected in each one of the impact grinding steps and said grains are removed from the impact disintegrated husk fragments, by means of flat sieves having a regulatable frequency and displacement, in order to obtain the maximum efficiency of the screening action, as well as an optimal stratification of the product.

In the first impact grinding step of the previously cleaned grain in order to loosen the first portion of the husk from the core of the grain by means of the above mentioned bolt mill and further separation or classification by means of a screening action, generally from 13 to 16% by weight of husk with a purity of up to about 98% is obtained. In the second impact grinding step and further screening, from 6 to 8% by weight of husk with a purity of 98% is obtained. In the third impact grinding and screening step, from 3 to 5% by weight of husk with a purity of about 96% is obtained, said latter step being sufficiently flexible to permit increasing or decreasing both the rpm and the number of bolts of the bolt mill and, therefore, for increasing the tangential velocity and the impact speed to accelerate, if desired, the total husking effect on the grain, even though this will produce a slight decrease in the purity of the husk obtained.

During the whole process which will be described in more detail hereinbelow, including the storage, the movement of the materials is effected by means of pneumatic conveyors and elevators, which systems are highly clean and free from any possible contamination, whereby the obtention of a product untouched by man and isolated from the environment is obtained, because said poduct is processed in closed machines.

Having now more particular reference to the drawings and more specifically to FIG. 1 thereof, there is shown, in a cross-sectional view to show inner details, a bolt mill which is suitable for carrying out the grinding steps utilized in the process in accordance with the present invention, which will be described in more detail hereinbelow in connection with FIGS. 2 and 3, said mill comprising a vertical shaft 1 journaled on an upper bearing 2 and a lower bearing 3, said upper bearing 2 being engaged by means of a retainer 4 and said lower bearing being closed by means of a retainer 5, all of the said assembly being rotatively supported on an approximately cylindrical shell 6, which closes the bearing chamber to avoid contamination with the dust from the environment. Shell 6 is hermetically closed on its upper end by means of a cover 8 which is adjusted with shell 6 through a suitable packing 7.

The central shaft or axle 1 is integrally fastened at its lower end to a suitable pulley 9 to connect the mill, by means of a suitable transmission, for example, V-type belts, to a motor which applies a rotational speed to shaft 1, of a suitable value to provide, at the bolt lines which will be described with more detail hereinbelow, the above mentioned necessary tangential velocity of from about 30 to about 40 m/sec., which is equivalent, for a mill having rotor dimension of approximately 40 cm., to between 1500 and 1700 rpm.

All the motion transmission assembly described above, is enclosed at its upper end by means of a cylindrical chamber 10 which has a conical cap 11, and which is in turn within a larger diameter cylindrical chamber 12, in order to form an annular feed duct 14, through which the *Plantago psyllium* seed passes to be fed to the mill, in the direction of the arrows indicated at the top of the figure.

The cylindrical chamber 12 is in turn supported on a base plate 17 which is continued with a frustoconical projection 18, between which projection and the outer wall of the shell 6, a frustoconical annular duct 15 is formed through which the material passes to reach the grinding chamber proper 16, which will be described in more detail in what follows.

The base plate 17 is supported by means of suitable projections on supports 28 distributed along the length of the circumference of the mill used in the process of the present invention.

At its lower end, the frustoconical projection 18 of the base plate 17 extends outwardly to form a circular plate 19 which constitutes the stator of the mill and which contains two circumferential lines of bores within which bolts 20 are introduced uniformly distributed in an inner array and bolts 21 uniformly distributed in a concentrical outer array, for a purpose which will be clearly seen in what follows.

At the lower end of shaft 1, by means of a special nut 70 or retainer, a plate 22 is arranged integrally joined to shaft 1 in order to rotate in unison therewith, for constituting the rotor of the mill.

The plate 22 or rotor, contains two concentrical circumferential arrays of holes within which bolts 23 are introduced for forming an outer array and bolts 24 for forming an inner array, said bolts being arranged such that they will form alternate arrays with the arrays of bolts 20 and 21 of the stator, as clearly illustrated in FIG. 1 of the drawings.

The stator 19 of the mill extends downwardly by means of a flange 29 which supports at its lower end a receptacle formed by a cylindrical portion 30 and a frustoconical portion 31, and having a lower opening 27 through which the ground material exits in the direction of the arrow indicated in FIG. 1 of the drawings. The rotor 22 has a diameter such that it will be of a smaller dimension that the diameter of the flange 29, such that an annular opening is provided throughout the edge of the rotor 22, said opening being indicated by means of the reference numeral 25, in order to permit the material to exit through the same to be discharged through chamber 26 towards the outlet 27 of the mill.

When the shaft 1 is rotated by means of pulley 9 and the corresponding associated engine, a rotating motion is applied to the bolts 23 and 24 of the rotor, which therefore causes the array of bolts 23 and 24 to rotate while the bolts 20 and 21 of the stator remain static for a purpose which will be described hereinbelow.

The *Plantago psyllium* seed fed through the opening 13 is appropriately distributed in the zone 14 by the cap or frustoconical baffle 11 of chamber 10, to pass through the duct 15 towards the grinding chamber 16 wherein the seed is violently striken by the moving bolts 23 and 24 of the rotor 22, to rebound the seed against the static bolts 20 and 21 of the stator 19, said seed being fed to the above described mill with a flow rate such that the seeds will be maintained individually spaced, in order that each one of said seeds may be individually striken by bolts 23 and 24 and may be also individually rebounded against bolts 20 and 21, a multiplicity of times until the loosening of the husk from the core of the seed fed is accomplished. The husked material which flows through the opening 25 towards chamber 26 is discharged through the outlet 27 of the mill, said mill being arranged in interrelationship with the remainder of the equipment of the system of the present invention such as will be described in more detail in connection with FIGS. 2 and 3 of the drawings.

Figure 2:
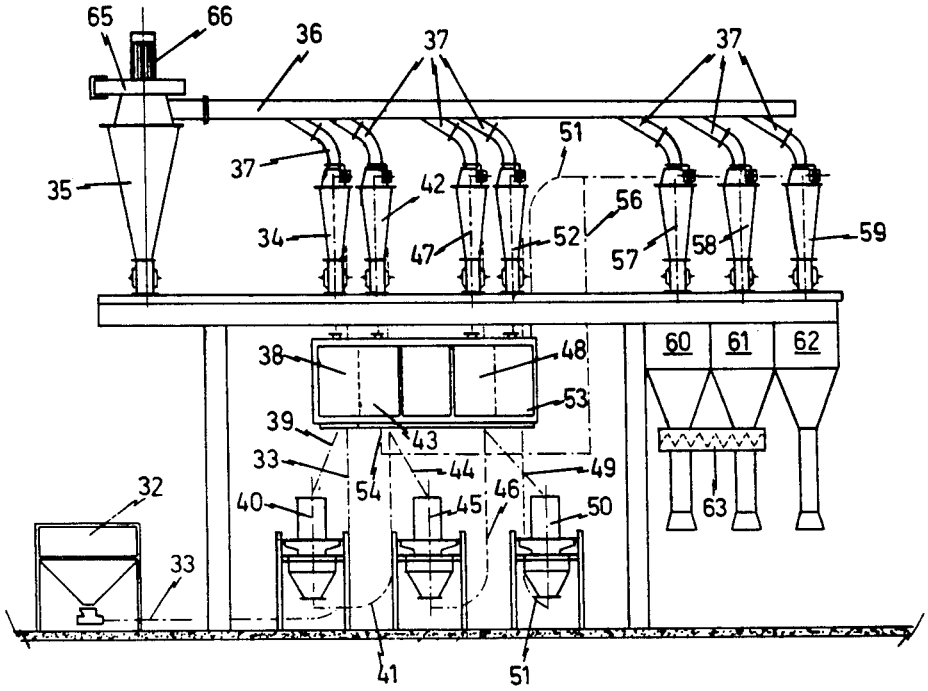
FIG. 2 is an elevational diagrammatical view of a complete system for carrying out the process for the obtention of high purity powdered husk from *Plantago psyllium* seed in accordance with the present invention.
Figure 3:
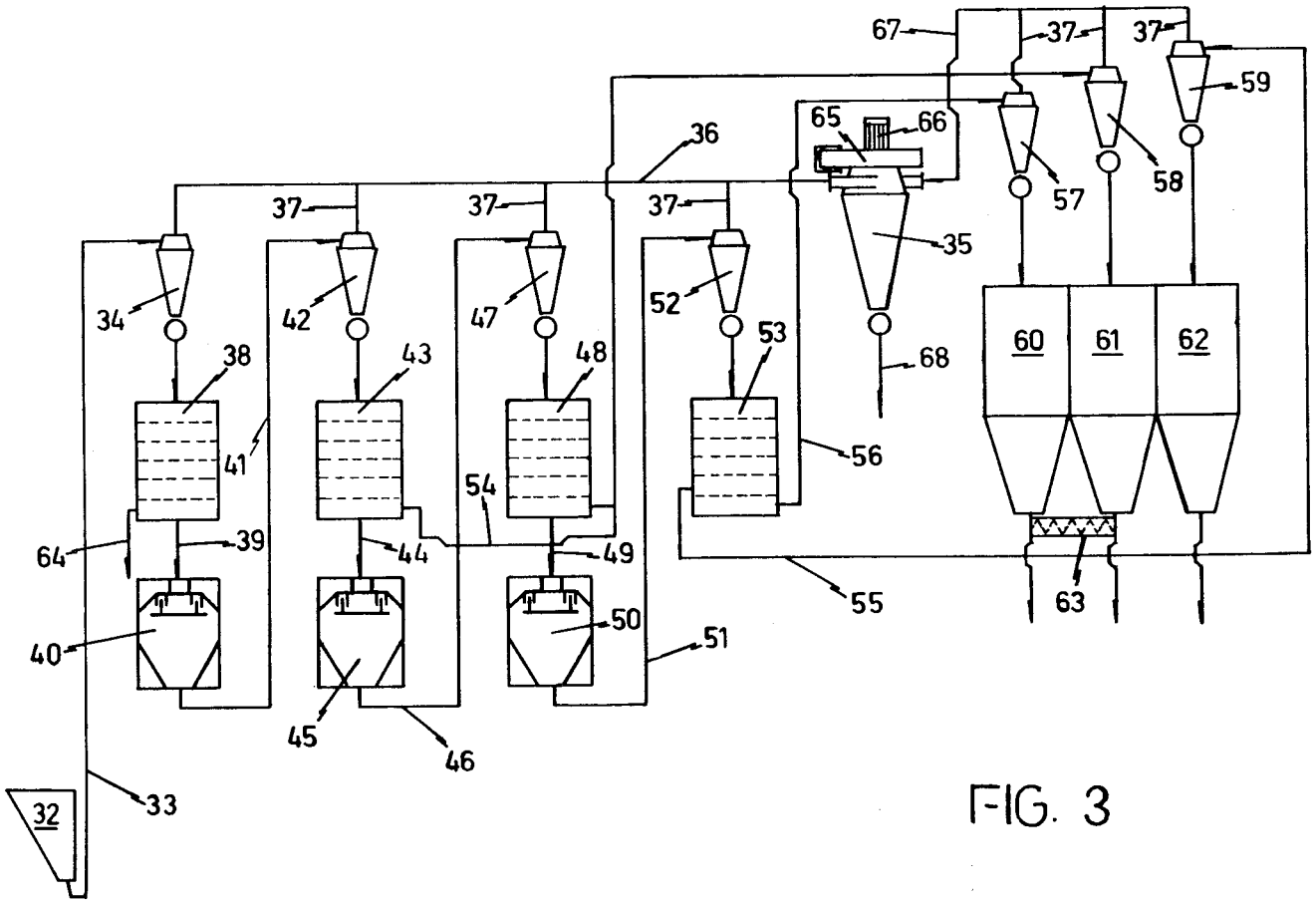
FIG. 3 is a flow sheet of the system illustrated in FIG. 2.

The process of preparing the powdered high purity husk of *Plantago psyllium* seeds (mucilage of *Plantago psyllium*) from integral *Plantago psyllium* seeds in accordance with the present invention is illustrated in detail in the flow sheet of FIG. 3 of the drawings, which is equivalent to the plant lay-out illustrated in FIG. 2, and to which reference will be had in what follows.

The dirty integral *Plantago psyllium* seed, such as collected in the field, is fed to the feed hopper 32, from which, by means of a pneumatic conveyor system which will be described in more detail hereinbelow, the dirty integral seed is elevated through line 33 towards a cyclonic separator 34 wherein the very light particles such as dust and leaf residues, etc., are removed and carried by the suction produced by the cyclonic separator 35 through line 36, to said cyclonic separator wherein said waste particles are removed and discarded through line 68.

The partially cleaned seed obtained from the cyclonic separator 34, is fed by gravity to a first sieve 38, which may be of any desired nature but which preferably is a flat sieve having a moderate displacement and a high frequency, both actions being controllable to accomplish a suitable stratification of the grains of the product, in order to remove the remainder of the waste materials which are discarded through line 64, whereas the cleaned seed passes by gravity through line 39, towards a first mill 40, which is of identical construction to that already described in connection with FIG. 1 of the drawings.

At this first mill 40 the first husking stage is carried out, wherein from approximately 13% to approximately 16% of husk having a purity of approximately 98% is obtained, and the husk admixed with the partially husked grain is pneumatically elevated through line 41 to a second cyclonic separator 42 which, by means of line 37 is connected to the vacuum line 36 previously described, and from said cyclonic separator 42 the admixed product falls to the second sieve 43, preferably of the same type described for sieve 38, wherein by means of screening and stratification the husk loosened in the mill 40 is separated, and carried through line 54 towards a cyclonic separator 58 which is connected by means of its line 37 to the second suction line 67 which also communicates with the cyclonic separator 35 which will be described in more detail hereinbelow. The husk suitably cleaned in the cyclonic separator 58, falls to a storage hopper 61.

The grain partially husked in the first grinding stage 40, falls through line 44 by gravity to a second mill 45, of an identical nature as that already described, in order to constitute a second grinding stage wherein approximately from 6% to 8% of husk with a purity of 98% is obtained. The mixed product is elevated through the pneumatic line 46 to a third cyclonic separator 47 which communicates by means of its line 37 to the suction line 36 and the cleaned mixed product falls by gravity to a third sieve 48, of the same above described structure, from where the husk is also fed through line 54 to the cyclonic separator 58 to be stored in receptacle 61 jointly with the husk originated in sieve 43. The grain husked in this second grinding step passes through line 49 by gravity to a third mill 50 having the same construction described above for mills 40 and 45 in accordance with FIG. 1, in order to constitute a third or final griding and husking step, wherein from approximately 3% to approximately 5% of husk with a purity of 96% is obtained, although it is to be noted that this last grinding step effected in mill 50, may be varied by increasing or decreasing the rpm's., or the number of bolts of mill 50, in order to increase the tangential velocity and the intensity of the impacts, to accelerate if desired the total husking effect of the grain, although the higher the velocity, the lower the purity to be obtained, that is, with a higher velocity a purity lower than 96% will be obtained for the powdered husk.

The mixed product passes through pneumatic line 51 to be elevated to a fourth cyclonic separator 52 which through its line 37 connects with the vacuum line 36 previously described and the desired product falls by gravity to a fourth sieve 53 of the same above described structure, from which the husk is removed and elevated through pneumatic line 56 to a cyclonic separator 57 which, through its line 37 connects with the suction line 67, to convey the husk to a hopper 60, separate from the hopper 61 which stores the husk obtained in the previous grinding steps, whereas the grain cores are elevated through line 55 to a cyclonic separator 59 also connected by means of its line 37 to the suction line 67, from which said grain cores are deposited in the receptacle 62 for further utilization.

All the pneumatic transportation system of the plant for producing *Plantago psyllium* husk as described above and as clearly illustrated in FIGS. 2 and 3 of the drawings, is rendered effective by means of the provision of a main cyclonic separator 35 which has a motor 66 operating a fan 65, for discharging the cleaned air to the atmosphere, said cyclonic separator 35 being provided with two tangential inlets corresponding to the suction lines 36 and 67, in order to carry out the pneumatic conveyance of the products in the plant, such as was described above. The waste material that are collected by the cyclonic separator 35, are discarded through line 68.

The hoppers or receptacles 60 and 61 for the powdered husk of *Plantago psyllium,* are interconnected at their outlets by means of a screw conveyor or mixer 63, which permits the production of any desired mixtures of powdered husk by using predetermined proportions of the lower quality powdered husk stored in the hopper 60 and predetermined proportions of the higher quality powdered husk stored in hopper 61, in accordance with the needs and the use to which said powdered husk is to be applied, although the powdered husks from receptacle 60 and from receptacle 61 may be packed separately, when the screw mixer 63 is not operative.

Although certain specific embodiments of the present invention have been shown and described above, it is to be understood that many modifications thereof are possible. The present invention, therefore, is not to be restricted except insofar as is necessitated by the prior art and by the spirit of the appended claims.

What is claimed is:

1. A process for the obtention of high purity mucilage from *Plantago psyllium* seeds, which essentially comprises the steps of:

(a) feeding previously cleaned integral *Plantago psyllium* seed to a grinding zone in which said seed is subjected to a grinding action by pure impact without rubbing, at an impact speed of from about 30 to about 40 m/sec., and with a feed flow rate of the integral seed to said grinding zone suitable to maintain the individual seeds individually spaced from each other in order that the strength of the impacts thereon may be the same for each seed, thereby separating and loosening of the husk from the core of the grain without disintegrating the latter;

(b) separating the husk loosened from the core of the seeds by the action of the impacts, by passing the same through a screening zone in which it is subjected to vibration through a suitable sieve to produce a stratification which separates the grains and the husked particles into separate layers;

(c) repeating steps (a) and (b) the necessary number of times to accomplish an optimal husking of the seeds; and (d) transporting the husk having a high content of the mucilage to storage of finished material.

2. A process according to claim 1 wherein said grinding action by pure impact is effected by providing a plurality of stationary arrays of impact elements in said grinding zone, alternated with a corresponding plurality of rotary arrays of impact elements, with said rotary arrays of impact elements striking the individual seeds to rebound them against said stationary impact elements.

3. A process according to claim 2 wherein each grinding step is effected by means of the utilization of a pure impact rotary mill not producing any rubbing on the grains, and comprising a rotor and a stator, said rotor including a plurality of concentrical circumferential arrays of bolts extending perpendicularly to the plane of the rotor, and said stator including a corresponding plurality of concentrical circumferential arrays of bolts extending perpendicularly to the plane of the stator, alternated with the arrays of bolts of the rotor, said rotor and said stator being circular plates arranged parallel to each other to form an impact chamber within which said bolts are located.

4. A process according to claim 3 wherein the flow rate of the grain fed into the rotary mill is regulated such that the grains will enter into said impact chamber spaced from each other so that the impact strength is the same for each individual grain and is accurate enough to permit the loosening of the husk without fracturing the core of the grain.

5. A process according to claim 2 wherein the grinding step (a) and the screening step (b) are effected in number of three each, in order to accomplish a progressive husking of the seed so as to obtain a powdered husk having a high purity and without fracture of the cores of the *Plantago psyllium* seed.

6. A process according to claim 5 wherein the first grinding and screening steps produce from about 13% to about 16% by weight of powdered husk having a purity of approximately 98%; the second grinding and screening steps produce from about 6% to about 8% by weight of husk with approximately 98% purity; and the third grinding and screening steps product from about 3% to about 5% by weight of husk with approximately 96% purity.

7. A process according to claim 6 wherein said third grinding step is accelerated by increasing the velocity of rotation of the rotary arrays of impact elements in order to increase the tangential velocity of the impacts to accomplish a faster husking effect on the grain, with a consequent decrease in purity of the thus produced husk.

8. A process according to claim 6 wherein said third grinding step is accelerated by increasing the number of impact elements in the grinding zone, in order to increase the frequency of the impacts on the grains so as to accomplish a faster husking effect on the grain, with a consequent decrease in the purity of the thus produced husk.

9. A process according to claim 1 wherein the husk obtained from the first and the second grinding and screening steps is stored jointly, whereas the husk obtained from the third grinding and screening step is separately stored, in order to classify by different qualities the powdered husk obtained in each grinding step.

10. A process according to claim 9 wherein further to the stages of separate storage of the first and second quality husk powders, an admixing zone is provided for the obtention of different mixtures of high purity husk powder with lower purity husk powder, in order to produce mixtures of said husk powders in the desired proportions.

11. A process for the obtention of high purity mucilage from *Plantago psyllium* seeds, which essentially comprises the steps of:

(a) feeding previously cleaned integral *Plantago psyllium* seed to a grinding zone in which said seed is subjected to a grinding action by pure impact without rubbing, at an impact speed of from about 30 about 40 m/sec., and with a feed flow rate of the integral seed to said grinding zone suitable to maintain the individual seeds individually spaced from each other in order that the strength of the impacts thereon may be the same for each seed;

(b) separating the husk loosened from the core of the seed by the action of the impacts, by passing the same through a screening zone in which it is subjected to vibration through a suitable sieve to produce a stratification which separates the grains and the husk particles into separate layers;

(c) repeating steps (a) and (b) the necessary number of times to accomplish an optimal husking of the seeds; and (d) recovering the husk particles having a high content of mucilage as a finished product.

12. A process according to claim 11 wherein the grinding step (a) and the screening step (b) are effected in a sequence of three each, in order to accomplish a progressive husking of the seed so as to obtain a powdered husk having a high purity and without fracture of the cores of the *Plantago psyllium* seed.

13. A process according to claim 12 wherein the sequence of grinding and screening steps is carried out such that the first grinding and screening steps produce from about 13% to about 16% by weight of powdered husk having a purity of approximately 98%; the second grinding and screening steps produce from about 6% to about 8% by weight of husk with approximately 98% purity; and the third grinding and screening steps produce from about 3% to about 5% by weight of husk with approximately 96% purity.

14. A process according to claim 13 wherein the husk obtained from the first and the second grinding and screening steps is stored jointly, whereas the husk obtained from the third grinding and screening step is separately stored, in order to classify by different qualities the powdered husk obtained in each grinding step.

* * * * *

UNITED STATES PATENT AND TRADEMARK OFFICE

CERTIFICATE OF CORRECTION

PATENT NO. : 4,813,613

DATED : MARCH 21, 1989

INVENTOR(S) : FELIPE SALETE

It is certified that error appears in the above-identified patent and that said Letters Patent is hereby corrected as shown below:

Column 1, line 29, after "thereby" insert -- . --;

, line 57, delete "ends" and substitute therefor -- seeds --;

Column 2, line 9, delete "found" and substitute therefor -- used --;

Column 3, line 30, delete "portin" and substitute therefor -- portion --;

Column 7, line 55, delete "ad-".

Signed and Sealed this

Twentieth Day of February, 1990

*Attest:*

JEFFREY M. SAMUELS

*Attesting Officer*

*Acting Commissioner of Patents and Trademarks*